US006969050B1

(12) United States Patent
Loebner

(10) Patent No.: US 6,969,050 B1
(45) Date of Patent: Nov. 29, 2005

(54) WEIGHTED PULLEY SYSTEM CROWD CONTROL STANCHION

(76) Inventor: Hugh G Loebner, 220 W. 98th St., #2B, New York, NY (US) 10025

( * ) Notice: Subject to any disclaimer, the term of this patent is extended or adjusted under 35 U.S.C. 154(b) by 639 days.

(21) Appl. No.: 09/684,658

(22) Filed: Oct. 10, 2000

(51) Int. Cl.[7] ..... E04H 17/00; E01F 13/02
(52) U.S. Cl. ..... 256/1; 256/38; 256/DIG. 2; 49/34
(58) Field of Search ..... 256/1, DIG. 2, 256/38; 49/34; 160/24

(56) References Cited

U.S. PATENT DOCUMENTS

| | | | | |
|---|---|---|---|---|
| 118,293 A * | 8/1871 | Stephens | 256/38 |
| 631,321 A * | 8/1899 | Owen | 256/38 |
| 1,653,670 A * | 12/1927 | Sawyer | 49/9 |
| 1,790,304 A * | 1/1931 | House | 49/34 |
| 2,153,708 A * | 4/1939 | Belsher | 49/34 |
| 5,501,429 A * | 3/1996 | Sakuma | 256/1 |
| 6,349,503 B1 * | 2/2002 | Gompertz | 49/34 |

FOREIGN PATENT DOCUMENTS

| | | |
|---|---|---|
| EP | 375580 A1 * | 6/1990 |
| FR | 817123 A * | 5/1937 |

* cited by examiner

*Primary Examiner*—Daniel P. Stodola
*Assistant Examiner*—Ernesto Garcia

(57) ABSTRACT

A crowd control stanchions having an extendible tape in which a weighted pulley system rather than a spring mechanism is used to maintain tape tension when the tape is extended and to retract the tape.

4 Claims, 5 Drawing Sheets

WEIGHTED PULLEY SYSTEM CROWD CONTROL STANCHION

BACKGROUND OF THE INVENTION

This invention relates to crowd control portable stanchion posts. Crowd control stanchions are portable post assemblies used by maintenance and other individuals to regulate pedestrian traffic. The stanchions are placed in a manner to indicate to pedestrians where the pedestrians should walk or queue.

Stanchions are generally not used singly. Flexible or rigid connecting members such as chains, ropes, tapes or rails are usually used to connect stanchion posts to each other, usually in a linear fashion, or to wall mounted rings. Most connecting members are independent. Independent connecting members can be removed from the stanchions. These independent connecting members have hooks or snaps at both ends to facilitate attaching the connecting members to stanchions.

Some stanchions, however, have extendible and retractable guidance tapes that are internally stored within a housing attached to, or part of, the stanchion. I use the term guidance tape to refer to an extendible tape have means to connect the tape to another stanchion or a wall mounted ring. The guidance tape is wound onto a reel that comprise part of the stanchion assemblies. These guidance tapes can be extended from the stanchion post by unwinding them from the reels. The virtue of a stanchion with an extendible internally stored guidance tape is convenience. First, there is no need to store the connecting member separately. The guidance tape is internal to the stanchion and stored with it. The guidance tape can not be lost. Second, an extendible guidance tape can be used to delineate any distance up to the maximum extension of the guidance tape. It is not necessary to stock multiple length connectors since the guidance tape can be extended as far as desired up to the maximum extension.

Said reels have spring mechanisms to keep the guidance tapes taut when extended and to rewind the guidance tapes after use. Extending the guidance tape causes the spring to be wound, storing potential energy in the spring. When it is desired to rewind the extended guidance tape, the stored potential energy spins the reel rewinding the guidance tape.

Although guidance tape stanchion posts with internal guidance tapes are convenient, spring rewind mechanisms have limitations. First, if a simple spring mechanism is used, the tension on the guidance tape will not be constant. As the guidance tape is extended, the spring will be wound fighter and the tension will increase. Constant force springs mechanisms reduce this problem to some degree, but they require additional complexity and expense. Second, spring mechanisms can, and frequently do, break. Breakage renders the guidance tape mechanism inoperable. Third, the guidance tapes in present systems are stored and extended in a vertical aspect. This results in a tendency for the top of the guidance tape to curl. The curling is exacerbated by the proclivity of pedestrians, when standing next to an extended guidance tape to hold and press down upon the top of the guidance tape, thereby causing even greater curling. Fourth, releasing a completely extended guidance tape may cause it to rewind with excessive speed. Braking means are possible but these increases cost and complexity. Finally, the longer the desired length of a guidance tape, the greater the necessary diameter of the reel. A large reel on the top of a stanchion post may be considered unsightly, limiting the maximum length of the guidance tape.

SUMMARY OF THE PRESENT INVENTION

My invention comprises a portable stanchion post using gravitational potential as energy storage means to retract an extended guidance tape. A weighted pulley means, rather than a spring, is used both to store gravitational energy for maintaining tension when the guidance tape is extended, retracting the guidance tape when desired, and as means to store the retracted guidance tape within the stanchion post.

The art of pulley design and construction is well known. Pulleys allow heavy objects to be hoisted with a force less than the weight of the object at the expense of having to move the force a greater distance than the weight to be moved. A pulley system with a five fold mechanical advantage, for example, can theoretically be used to lift a 100 lb. weight with a force of only 20 lbs., but the 20 lb. force must be moved through a distance 5 times the distance that the weight is lifted. In reality, a force of more than 20 lbs. would be needed to overcome energy lost through friction.

Although the use of the pulley to lift heavy weights is ancient and well understood, it is not generally appreciated that the system can be used in reverse. A comparatively large force can be moved through a short distance to move a lesser force through a longer distance. That is the essence of the present pulley stanchion system.

The weighted pulley system comprises a top block assembly and a bottom block assembly. Each block assembly comprises a block, that is a case, and a plurality of rollers that are held within the case. The top block assembly comprises, in addition to the plurality of rollers, a ring to which a snap end can be attached and a threaded stud to which a decorative finial may be attached. The bottom block assembly comprises, in addition to the plurality of rollers, a weight and a membrane.

The guidance tape is stored as multiple plies laced between the two block assemblies. When the guidance tape is extended from the stanchion, the bottom block assembly rises. When the directional guidance tape is retracted the bottom block assembly drops within the post. The distance that the bottom block assembly rises and falls relative to the distance that the guidance tape is extended depends on the number of plies of the guidance tape. For every inch that the bottom block assembly rises or falls, the guidance tape will extend or retract N inches, where N is the number of plies.

A membrane attached to the bottom block assembly provides a seal between said bottom lock assembly and the post. This permits pneumatic braking when the guidance tape is being retracted.

The pulley stanchion system which I describe has the advantages that (1) it removes the complexity of spring mechanisms, (2) it uses gravity to provide a constant force over the entire extension range of the guidance tape, (3) in its natural configuration the extendible guidance tape is extended in an horizontal aspect, thus reducing curling, (4) the bottom block assembly with membrane act as a piston, providing simple and efficient pneumatic braking when the guidance tape is being retracted and (5) the guidance tape is stored as multiple linear plies within the length of the stanchion tube rather than on a bulky circular reel.

DESCRIPTION OF THE PREFERRED EMBODIMENT

Figure 1:
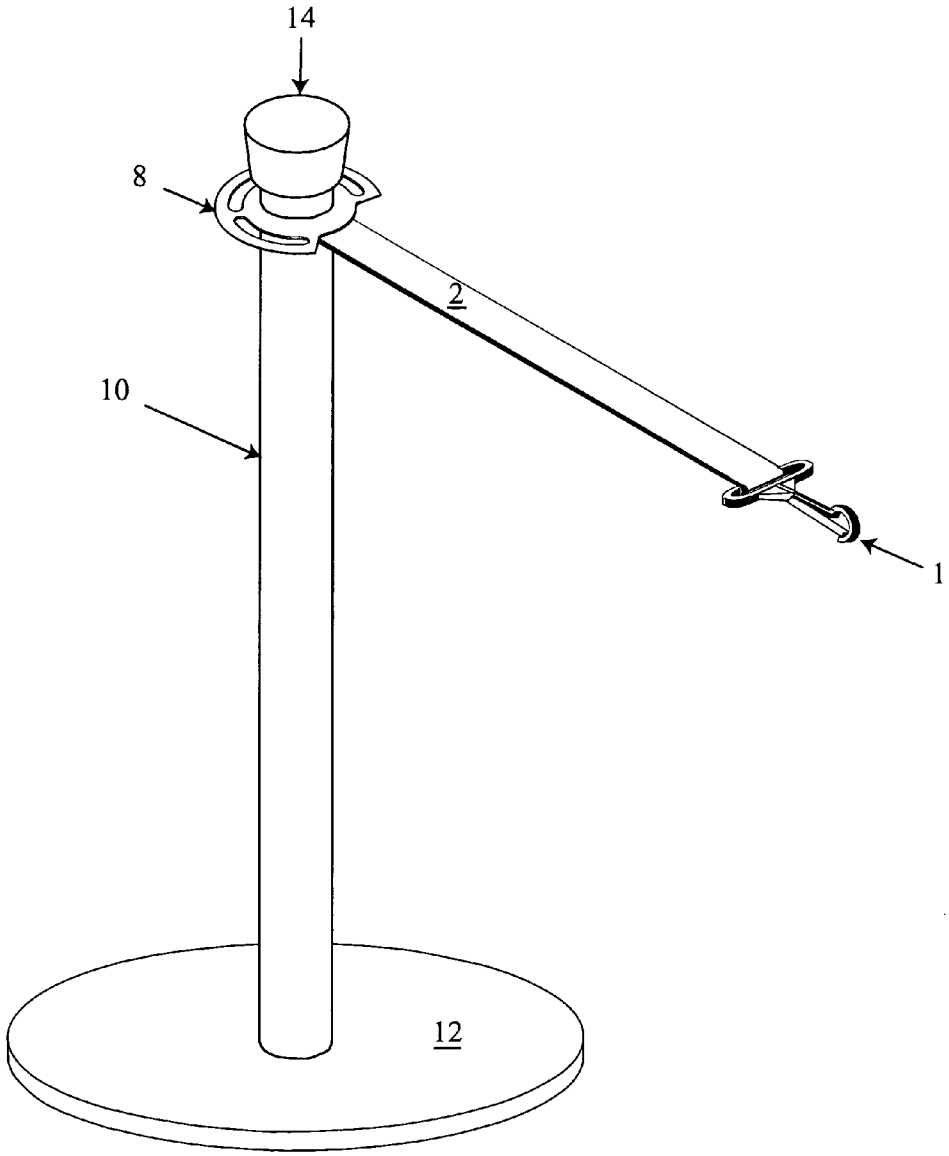
FIG. 1 is a perspective view of the stanchion showing.

FIG. 1 shows a perspective view the preferred embodiment of my invention. The stanchion comprises a base 12 attached to a post 10. Extending from top assembly 8 is tape 2. At the end of tape 2 is snap end 1.

I have found that an 18 gauge 2 inch diameter tube 34 inches in length attached to an 14 inch diameter base are a suitable post and base combination.

A variety of means may be used to attach the post to the base. One method is to weld the post to the base. An other method is to have a threaded hole in the base and, in the tube, a tube connector such as Gabriel Glide Co.'s 302-2000-06-18. A threaded stud can thus be used to attach the tube to the base. With this method, the post can be screwed onto, and unscrewed from, the base for ease of storage and transportation. The specific method of attachment is not important except that the base should provide a relatively air tight seal at the bottom of the post so that pneumatic braking may be used to slow the descent rate of the bottom block, and hence the tape retraction speed.

Fixed to the top of post 10 is top block assembly 8. Visible in FIG. 1 is the attachment ring part of top assembly 8. Decorative finial 14 is shown on top of top block assembly 8. Extending from top block assembly 8 is tape 2. Snap end 1 is attached to tape 2. In the normal use of the stanchion, tape 2 is extended and snap end 1 is snapped onto the attachment ring of a second stanchion or onto a wall mounted ring.

Figure 3:
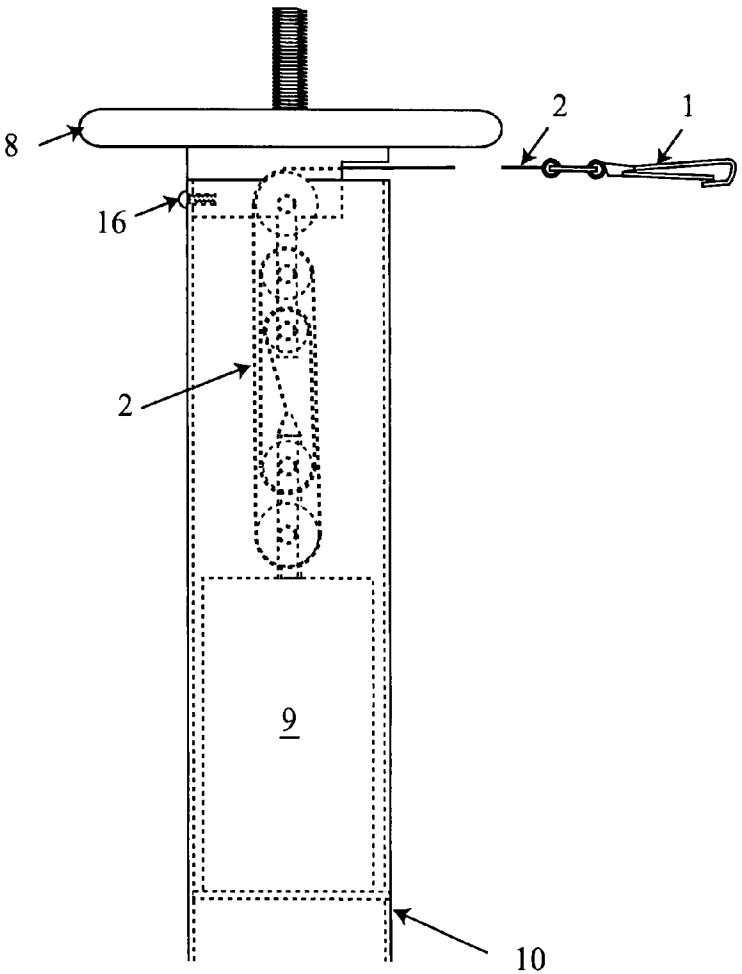
FIG. 3 is a side view of the mechanism showing the disposition of the top and bottom pulley mechanisms and their associated rollers relative to the stanchion post.
Figure 2:
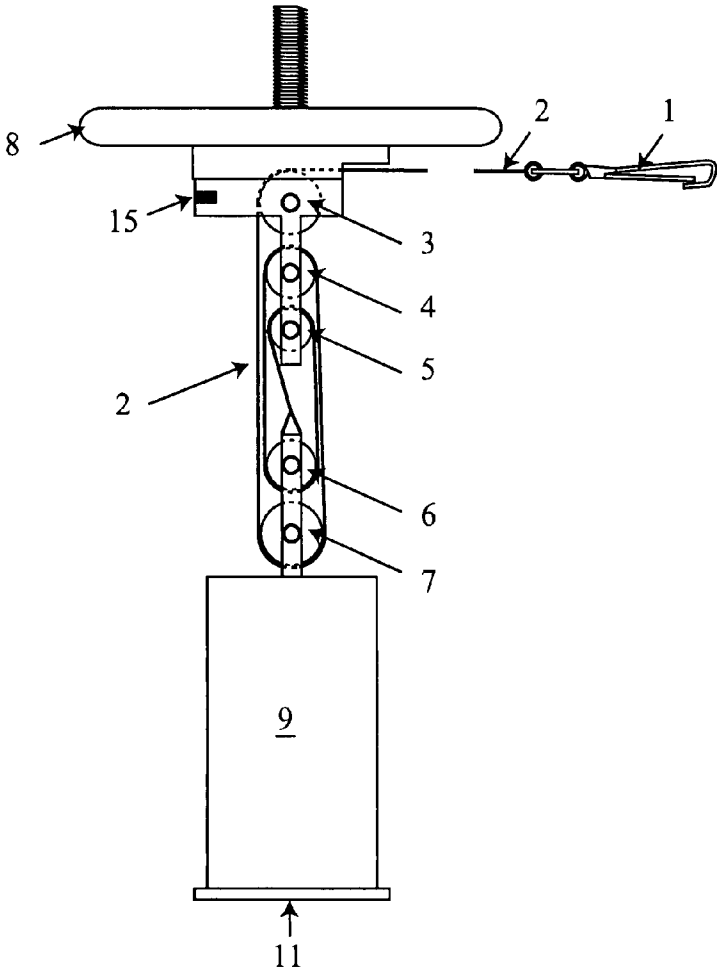
FIG. 2 is a side view of the tape storage/pulley mechanism showing the path extendible guidance tape follows through the rollers of top block assembly and bottom block assembly.

FIG. 2 shows how the components of the pulley system are disposed relative to each other and the path that tape 2 follows. Tape 2 passes over top assembly top roller 3, under bottom assembly bottom roller 7, over top assembly middle roller 4, under bottom assembly top roller 6, over top assembly bottom roller 5, and finally is attached to the top of bottom block assembly 9. From FIG. 2 it can be seen that the rollers comprising each block assemblies are of different diameters. This permits the multiple plies of tape to avoid touching. This configuration reduces friction when the tape is being extended or retracted. FIG. 3 shows how the components are disposed internally to post 10.

Top block assembly is seated on the top rim of post 10 and bottom block assembly 9 is contained within post 10. Tape 2 is contained within the post 10 laced as multiple plies between top and bottom block assemblies. In the preferred embodiment, there are five plies of tape. Tape 2 will extend or retract five inches for every inch that bottom block assembly rises or falls within post 10. I have found that a 6.5 inch long bottom block assembly used in conjunction with the depicted top block assembly has, within a 34 inch long tube, a range of vertical movement of about 2 foot. This provides a maximum tape extension of approximately 10 feet.

Figure 6:
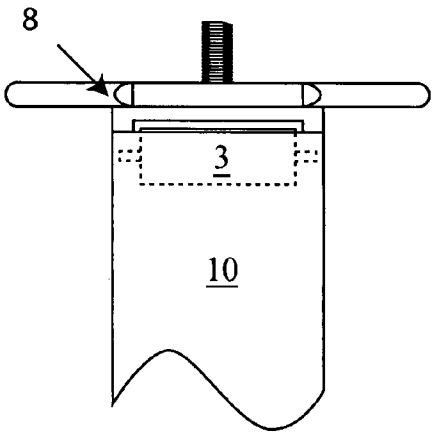
FIG. 6 is a partial view of top block, post, and top roller, showing how top surface of top roller clears the top rim of stanchion post.
Figure 5:
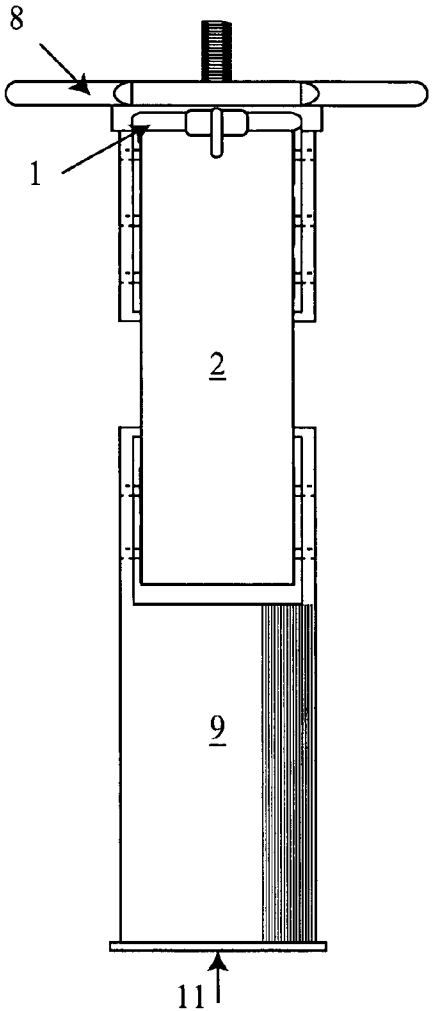
FIG. 5 is a front view of top and bottom pulley mechanism showing tape and snap end.
Figure 4:
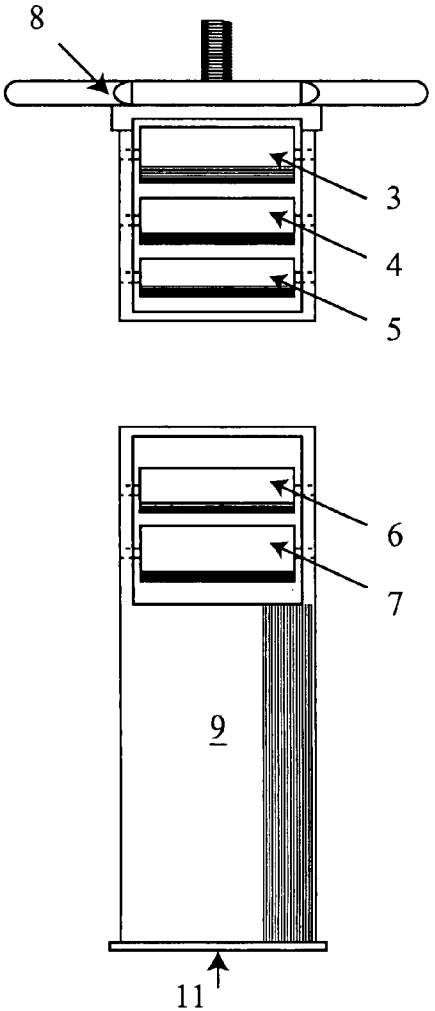
FIG. 4 is a front view of top and bottom block assemblies including blocks and rollers.

FIG. 3 and FIG. 6 show how the top roller 3 is disposed relative to the top rim of post 10. Top assembly 8 has a flange or lip which seats assembly 8 on the top rim of post 10 such that the top of roller 3 is above the rim of post 10. This permits tape 2 to exit from top block assembly 8 over the rim of post 10 without touching post 10. FIG. 3 also shows a small screw 16 (such as a #8 machine screw ⅜ inches long) used to attach top block assembly 8 to post 10. FIG. 2 shows hole 15 into which screw 16 is threaded.

Figure 8:
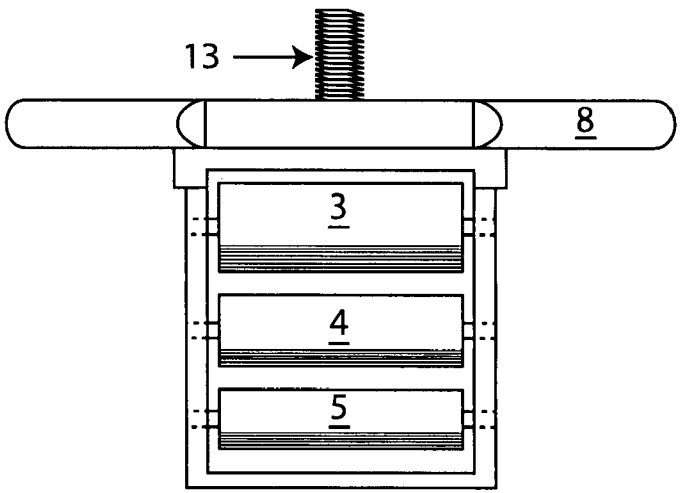
FIG. 8 is a front view of top block assembly.
Figure 7:
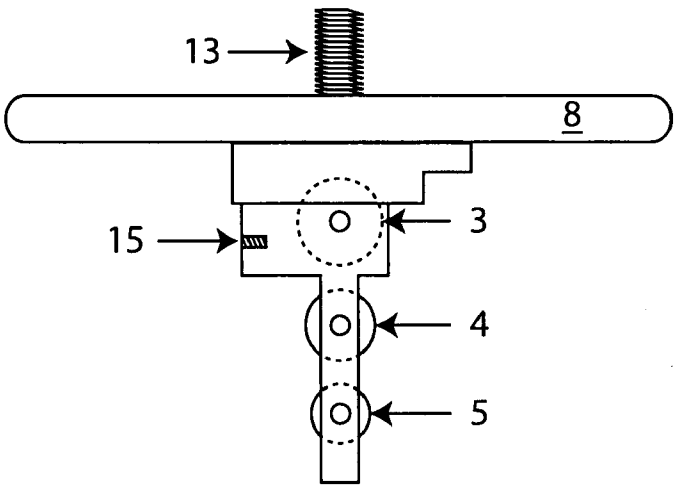
FIG. 7 is a side view of top block assembly.
Figure 9:
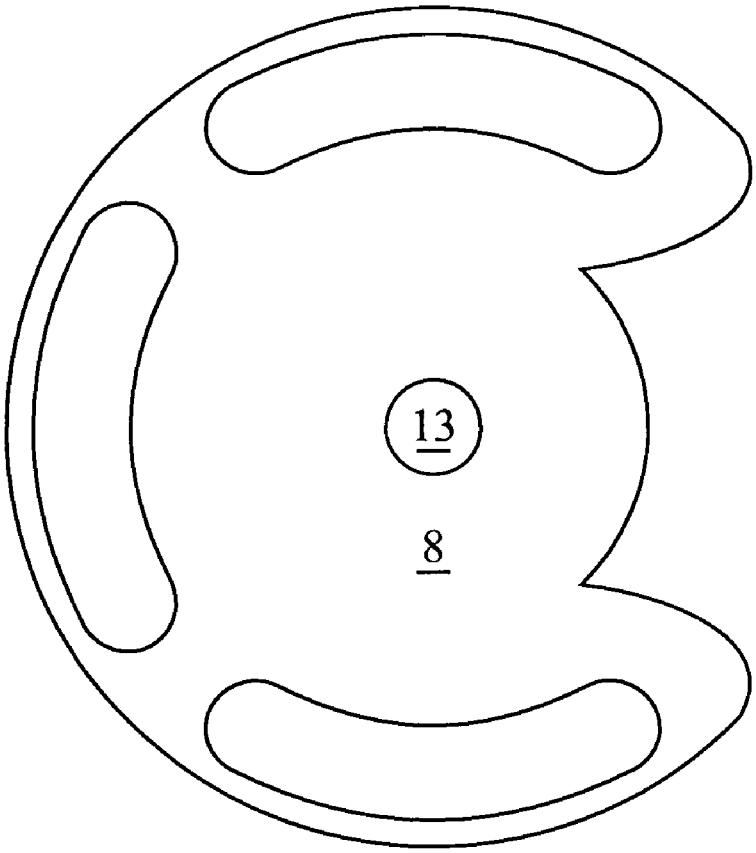
FIG. 9 is a top view of top block assembly showing attachment ring.

FIG. 7 and FIG. 8 show side and front views of top block assembly 8 with rollers 3, 4, and 5. FIG. 9 shows a top view of the preferred ring design of top block assembly 8.

The bottom block assembly must be of sufficient weight to provide sufficient tension to keep the extendible tape taut when extended and to overcome frictional forces when the tape is retracted. I have found that an steel bottom block assembly having overall length of 6.5 inches and 1.87 inch diameter weighs approximately 3.8 lbs. and serves well. The exact weight is not critical.

Attached to the bottom is a circular membrane 11 to provide a seal between the bottom block assembly and the interior wall of the tube. The membrane slows the escape of air from the space between the bottom of the block assembly and the bottom of the tube when the block assembly descends, thus slowing the rate of descent of the bottom block assembly. The art of pistons and sealing pistons is well understood. I have found that a 2 inch diameter disk of tempo nylon velour material serves to slow the descent of the bottom block assembly.

Those skilled in the art will understand that although the embodiment described here uses a pulley system with five plies of tape, alternative configurations are possible with a different number of plies. They will also understand that although I have described the top block assembly as comprising a ring and means for attaching a decorative finial, other configurations are possible. For example, it would be possible to integrate the decorative final as part of the top block assembly, or to dispense with a decorative finial completely and provide the top block assembly with a finished, flat, top. Also, although I have described a snap end and attachment ring as the means of attaching the extendible tape to a companion stanchion, other attachment means are possible. Also, the attachment ring can be a separate component distinct from the top block assembly.

In this construction the electric heating elements are positioned directly beneath the iron grid bars and melted fat is carried off in grooves formed in the upper surfaces of the bars.

I claim:

1. An extendible guidance tape crowd control stanchion comprising (a) a base (b) a post attached to said base, (c) an extendible guidance tape contained within said post; said guidance tape comprising (d) a snap end, (e) a tape, (f) gravity means to retract said tape, and (g) means to brake the retraction of said guidance tape by air piston means.

2. An extendible guidance tape crown control stanchion according to claim 1 where said air piston means of slowing the retraction of said guidance tape comprises a membrane attached to said weight means.

3. A griller as claimed in claim 1 wherein the power consumption of the heater element is 1250 watts and the weight of the grill member is about 3.5 kg.

4. An extendible guidance tape crowd control stanchion according to claim 3 where said air piston means of slowing the retraction of said guidance tape comprises a membrane attached to said weight.

* * * * *